US006076493A

United States Patent [19]

Miller et al.

[11] Patent Number: 6,076,493

[45] Date of Patent: Jun. 20, 2000

[54] GLOW PLUG SHIELD WITH THERMAL BARRIER COATING AND IGNITION CATALYST

[75] Inventors: Robert L. Miller, Dunlap; Kenneth J. Suda, Edelstein; Kent A. Koshkarian, Peoria, all of Ill.

[73] Assignee: Caterpillar Inc., Peoria, Ill.

[21] Appl. No.: 09/178,985

[22] Filed: Oct. 26, 1998

[51] Int. Cl.[7] ..... F02B 9/08

[52] U.S. Cl. ..... 123/145 A

[58] Field of Search ..... 123/145 A

[56] References Cited

U.S. PATENT DOCUMENTS

| | | | |
|---|---|---|---|
| 2,198,850 | 4/1940 | White | 123/145 |
| 4,358,663 | 11/1982 | Sperner et al. | 219/270 |
| 4,418,661 | 12/1983 | Esper et al. | 123/145 |
| 4,459,948 | 7/1984 | Bauer | 123/145 |
| 4,641,612 | 2/1987 | Chalke | 123/145 |
| 5,182,437 | 1/1993 | Schmidt et al. | 123/145 |
| 5,580,476 | 12/1996 | Dam et al. | 219/270 |
| 5,593,607 | 1/1997 | Dam et al. | 219/270 |
| 5,626,781 | 5/1997 | Schmidt et al. | 123/145 |
| 5,645,742 | 7/1997 | Schmidt et al. | 123/145 |
| 5,676,100 | 10/1997 | Dam et al. | 123/145 |

*Primary Examiner*—John Kwon
*Attorney, Agent, or Firm*—Stephen J. Church; Larry G. Cain

[57] ABSTRACT

A glow plug shield centrally receives a glow plug which, typically, has a silicon nitride surface. The shield and plug are spaced radially from a fuel injector disposed centrally of a cylinder head. The shield and glow plug extend into a combustion chamber where the shield has an oblique end exposing the circumferential portion of the plug which faces the injector. This shield configuration protects the glow plug from cooling by inlet air, increases the residence time of air/fuel mixture around the plug, and improves flame propagation so that plug temperature and electrical power can be reduced to extend glow plug life. The shield has a coating exteriorly and interiorly covering the portion of the shield extended into the combustion chamber. The coating is of thermally insulating, high temperature resistant ceramic material and acts as a thermal barrier to further reduce glow plug cooling. A combustion catalyst such as platinum or palladium may be incorporated into the coating to further reduce the required glow plug temperature and electrical power.

16 Claims, 1 Drawing Sheet

GLOW PLUG SHIELD WITH THERMAL BARRIER COATING AND IGNITION CATALYST

TECHNICAL FIELD

The present invention relates to electric incandescent ignitors for internal combustion engines. More particularly, the invention relates to such ignitors having a structure which includes a housing insertable into a space to be heated and which includes an element having a coating containing a metal oxide or an ignition catalyst.

BACKGROUND OF THE INVENTION

Glow plugs are used to assist ignition in internal combustion engines, as for non-autoignitable fuels. Although a glow plug portion exposed to combustion is typically constructed of silicon nitride, the life of a glow plug is relatively short due to corrosion and erosion of the silicon nitride at the elevated temperature at which a glow plug must be maintained to sustain good combustion.

It is known to provide protective tubular shields of metal or ceramic circumferentially surrounding a glow plug along its length. The shield is spaced from the glow plug and is perforated and/or open at an axial end for access of combustible mixture to the glow plug. It is also known to protect a silicon nitride glow plug by coating the plug with a refractory metal oxide and to provide a glow plug with a combustion promoting catalyst so that the glow plug temperature may be reduced.

SUMMARY OF THE INVENTION

The present invention includes a glow plug shield having a generally cylindrically tubular configuration and centrally receiving an electrically heated glow plug which, radially, is spaced inwardly of the shield and, typically, is constructed of silicon nitride. The shield and plug are adjacent to one or more intake valves and to a fuel injector. An end portion of the shield extends into a combustion chamber and terminates at a plane which is obliquely related to the axis of the shield and which is disposed so as to expose the circumferential portion of the plug which faces the injector.

The invention involves a coating covering the interior and the exterior of the shield portion which extends into the combustion chamber. The coating is constructed of a ceramic refractory material, such as a metal oxide, such that the coating is a thermal barrier which reduces cooling of the glow plug by inlet gas and reduces the electrical power needed by the glow plug to maintain the surface thereof at a temperature sustaining good combustion.

Optionally, a combustion catalyst, such as platinum or palladium, can be incorporated into the coating to further reduce the required glow plug temperature and electrical power.

DETAILED DESCRIPTION OF THE INVENTION

Figure 1:
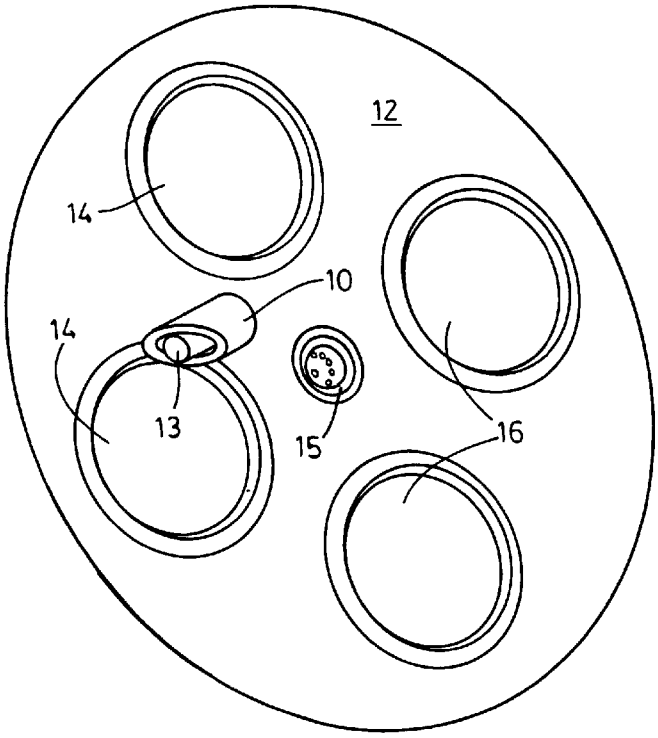
FIG. 1 is a perspective view of a cylinder head surface and associated devices including a glow plug shield embodying the principles of the present invention.

FIG. 1 shows a glow plug shield 10 embodying the principles of the present invention in a representative operating environment including a planar and circular cylinder head surface 12 forming an end of a combustion chamber of an internal combustion engine. The glow plug shield is inserted into the surface. The shield centrally receives a glow plug 13 which is of generally cylindrical configuration and extends from the surface into the combustion chamber. The shield is disposed between and is adjacent to the heads of a pair of valves 14 or 14 and 16. A fuel injector 15 has spray openings at the center of the surface 12, and the intake valves are disposed oppositely of the injector from the heads of a pair of exhaust valves 16. It is apparent that a peripheral portion of the glow plug is disposed toward and thus faces the fuel injector. The configurational and material details of surface 12 and devices 13–16 are not a part of the present invention and are not further described.

Shield 10 is of a generally cylindrical tubular configuration and has an oblique end 20 spaced from surface 12 into the combustion chamber. This oblique end is disposed so as to expose, in a direction toward the fuel injector, the before mentioned peripheral portion of the plug which faces the injector. As is apparent from FIG. 1, the shield is disposed in partially circumscribing relation to the glow plug.

Figure 2:
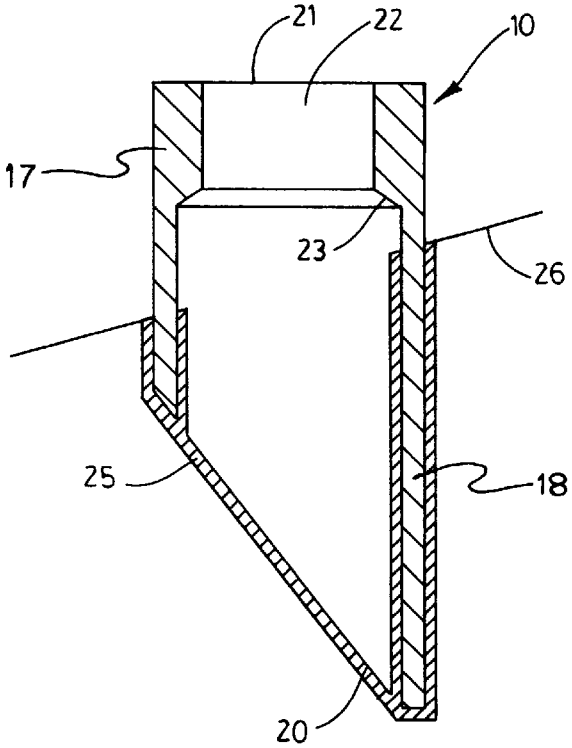
FIG. 2 is an axial section of the glow plug shield of FIG. 1.

The shield has an end 21 axially opposite to oblique end 20. End 21 is shown in FIG. 2, and, in FIG. 1, is located within surface 12. The shield has a central bore 22 for reception of glow plug 13 which, in FIG. 2, is omitted for illustrative convenience. The central bore is enlarged at a shoulder 23 so that, toward its oblique end, the shield is spaced radially outwardly from the glow plug. The shield thus has an exterior surface and has an interior surface larger in diameter than the glow plug.

Shield 10 has a coating 25 which covers the portion of the shield extended from surface 12 and which is deposited on a metal body forming the balance of the shield. This coating extends exteriorly and interiorly of the shield over and from oblique end 20 to a termination plane 26 which is coplanar with surface 12 when shield 10 is inserted therein. It is apparent from FIG. 2 that plane 26 and the plane of oblique end 22 both extend transversely of the shield.

The depicted configuration of shield 10 protects glow plug 13 from being cooled by inlet gas from adjacent valves 14, increases the residence time of air/fuel mixture around the plug, and improves flame propagation out from the glow plug. As a result, the temperature of the glow plug surface and the electrical power needed by the glow plug to sustain good combustion are reduced so that glow plug life is extended.

As before mentioned, coating 25, which is constructed of a ceramic refractory material, serves as thermal barrier which reduces cooling of glow plug 13 by inlet gas; and a combustion catalyst may be incorporated into the coating to also reduce the required glow plug temperature and electrical power. The coating and catalyst thus further extend glow plug life.

As seen in FIG. 2, coating 25 is applied to the inner and the outer circumferential surfaces of glow plug shield 10 as well as to the shield surface at oblique end 20. This coating can be applied by any suitable methods as by plasma spraying, dip coating, or spraying. The coating is a thermally insulating, high temperature resistant ceramic material. Zirconia or an inorganic cement, such as a phosphate bonded material, is believed to be effective. Typically, the coating is applied in thickness of about 0.005 to 0.015 inch (0.13 to 0.38 mm).

The combustion catalyst is typically one or a combination of several elements from the precious metal group such as platinum or palladium and can be incorporated into coating 25 by any suitable method such as deposition with the coating or later by solution infiltration or sputtering.

Although the present invention has been described in connection with what is conceived to be a practical and preferred embodiment, it is recognized that departures may be made therefrom within the scope of the invention which is not limited to the illustrative details disclosed.

What is claimed is:

1. A glow plug comprising:

a shield having a first portion and a second portion, said first portion being inserted into a surface, and said second portion extending from said surface and having a coating of a thermal barrier material.

2. The glow plug shield of claim 1 wherein the thermal barrier material is a refractory ceramic.

3. The glow plug shield of claim 2 wherein a combustion catalyst is incorporated into said refractory ceramic.

4. The glow plug shield of claim 2 wherein said refractory ceramic is coated on a metal body.

5. The glow plug shield of claim 1 wherein the shield is of cylindrically tubular configuration so as to receive a glow plug centrally of the shield.

6. The glow plug shield of claim 5 wherein a portion of the shield is interiorly larger in diameter than a glow plug received in said portion, and said portion is coated exteriorly and interiorly with said thermal barrier material.

7. The glow plug shield of claim 6 wherein said thermal barrier material is a refractory ceramic and is coated on a metal body.

8. The glow plug shield of claim 7 wherein a combustion catalyst is incorporated into said refractory ceramic.

9. A glow plug comprising:

a shield having a cylindrically tubular body, said cylindrically tubular body having an interior surface, an exterior surface, and a pair of axially opposite ends, said body having a portion defined between a plane disposed transversely of said body and one of said opposite ends; and a coating constructed of a refractory ceramic material deposited on said portion of said body.

10. The glow plug shield of claim 9 wherein a combustion catalyst is incorporated into said refractory ceramic.

11. The glow plug shield of claim 9 wherein said one of said opposite ends extends along a plane disposed obliquely to said cylindrically tubular body.

12. The glow plug shield of claim 11 wherein said coating covers said portion of said body at said exterior surface, said interior surface, and said one of said opposite ends.

13. A combination for use in an internal combustion engine, the combination comprising:

a surface at least partially defining a combustion chamber;

a fuel injector having an opening at said surface;

a generally cylindrical glow plug extending from said surface into the combustion chamber, said glow plug being spaced from said fuel injector and having a peripheral portion disposed toward said fuel injector; and a tubular glow plug shield extending from said surface in at least partially circumscribing relation to said glow plug, said shield being coated with a refractory ceramic.

14. The combination of claim 13 wherein a combustion catalyst is incorporated into said refractory ceramic.

15. The combination of claim 13 wherein said glow plug shield terminates in said combustion chamber at a plane extending obliquely to said glow plug and disposed so that said peripheral portion of said glow plug is exposed in a direction toward said fuel injector.

16. The combination of claim 15 wherein a combustion catalyst is incorporated into said refractory ceramic.

* * * * *